United States Patent [19]

Komatsu et al.

[11] Patent Number: 4,487,791

[45] Date of Patent: Dec. 11, 1984

[54] OXYGEN ABSORBENT PACKAGING

[75] Inventors: Toshio Komatsu; Yukio Kondoh, both of Tokyo, Japan

[73] Assignee: Mitsubishi Gas Chemical Co., Inc., Tokyo, Japan

[21] Appl. No.: 377,127

[22] Filed: May 11, 1982

[30] Foreign Application Priority Data

May 12, 1981 [JP] Japan ..... 56-71170

[51] Int. Cl.[3] ..... B32B 3/10

[52] U.S. Cl. ..... 428/35; 426/106; 426/124; 426/316; 428/137; 428/138

[58] Field of Search ..... 426/106, 124, 316; 428/35, 137, 138

[56] References Cited

U.S. PATENT DOCUMENTS

| | | | |
|---|---|---|---|
| 4,104,192 | 8/1978 | Yoshikawa et al. | 426/544 |
| 4,113,652 | 9/1978 | Yoshikawa et al. | 426/124 |
| 4,127,503 | 11/1978 | Yoshikawa et al. | 252/440 |
| 4,166,807 | 9/1979 | Komatsu et al. | 426/124 |
| 4,192,773 | 3/1980 | Yoshikawa et al. | 426/124 |
| 4,287,995 | 9/1981 | Moriya | 426/124 |
| 4,332,845 | 6/1972 | Nawata | 428/35 |
| 4,384,972 | 5/1983 | Nakamura et al. | 426/124 |

FOREIGN PATENT DOCUMENTS

| | | | |
|---|---|---|---|
| 3004325 | 8/1980 | Fed. Rep. of Germany | 426/124 |
| 54-103193 | 8/1979 | Japan . | |

*Primary Examiner*—John E. Kittle

*Attorney, Agent, or Firm*—Leydig, Voit, Osann, Mayer and Holt

[57] ABSTRACT

An oxygen absorbent package comprising a plastic microporous film or nonwoven fabric sheet 1 and a laminated sheet 2 comprising a plastic film 3 having a lower softening point than 1 and a plastic film 4 having a higher softening point than film 3, an oxygen absorbent 5 being put between 1 and 2 with film 3 forming the inner layer, the three layers being heat-sealed on the sides is disclosed. The oxygen absorbent is mainly used for storage of foodstuff, particularly liquid or semi-liquid foodstuff.

2 Claims, 1 Drawing Figure

OXYGEN ABSORBENT PACKAGING

BACKGROUND OF THE INVENTION

The present invention relates to an oxygen absorbent package using a microporous film or nonwoven fabric as at last part of material constituting the package.

Oxygen absorbents are widely used to keep oxygen out of the atmosphere in which foods and other products that do not like oxygen are stored. But if oxygen absorbents are used in connection with the storage of moist products and materials constituting the package packing oxygen absorbents are water permeable, the moisture enters the interior of the package of the absorbent and aqueous slurry of oxygen absorbent is formed. The aqueous slurry oozes out of the package and smears the foodstuffs.

Active research and development efforts have recently been made on thin plastic films such as microporous films and nonwoven sheets. Since these thin plastic films are as highly air-permeable as paper, they can be used as a material for packaging oxygen absorbents. However, this film is usually made of a single layer of polyolefin such as polyethylene and polypropylene, so it is difficult to heat-seal the microporous film by means of conventional packaging machines. The reason is that when two sheets of mono-layer films are adhered by melting inside portions of the mono-layer film, melted film is adhered to heat-seal bars or heat rolls of machine. A special heat-sealer, such as an impulse heat-sealer is necessary in order to heat-seal mono-layer film. When such special heat sealer is used in automatic packaging machines in order to heat-seal the mono-layer film, it is impossible to operate the automatic packaging machine at a high speed. So, when the mono-layer film is heat-sealed by an impulse heat-sealer, a decrease in efficiency is unavoidable. In addition, a microporous film is weakened. So a microporous film is not practical as a packaging material for packing an oxygen absorbent.

Oxygen absorbent packages using a plastic nonwoven sheet are disclosed in several prior art references. For example, Japanese Patent Publication (Kohkai) No. 2164/81 discloses a composite package including at least two layers, i.e. the plastic nonwoven sheet and an oxygen permeable but water-impermeable layer. But this package has the nonwoven sheet laminated or coated with a thermoplastic synthetic resin to reduce the inherent high gas permeability of the nonwoven sheet, so if the oxygen absorbent is put in the package, the desired oxygen removal rate is not obtained.

SUMMARY OF THE INVENTION

The present invention eliminates these defects.

An object of the present invention is to provide an oxygen absorbent package that retains the high gas permeability of plastic microporous films or nonwoven sheets and which yet can be processed by conventional packaging machines.

Another object of the present invention is to provide a waterproof oxygen absorbent package.

DETAILED DESCRIPTION OF THE INVENTION

Figure 1:
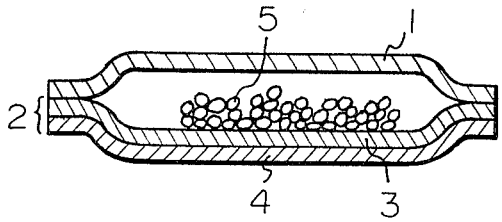
FIG. 1 shows a first embodiment of the package of this invention and is a fragmentary sectional view of the package.

In accordance with the invention, an oxygen absorbent package is provided comprising a plastic microporous film or nonwoven fabric sheet 1 and a laminated sheet 2 comprising a plastic film 3 having a lower softening point than film or sheet 1 and a plastic film 4 having a higher softening point than film 3, an oxygen absorbent 5 being put between films 1 and 2 with film 3 forming the inner layer, the three layers being heat sealed on the sides.

By the term "microporous film" is meant a film having a plurality of fine openings and being gas-permeable, but water-impermeable when there is no difference between pressure outside the bag and pressure in the bag. The size of the openings is preferably in the range of 0.01–50 microns, and a distance across the short axis is less than 2 microns. Materials constituting the film include plastics, such as polyethylene, polypropylene, poly(fluorinated ethylene) and the like. The microporous film employed in the practice of this invention may be prepared by: cold orientation of film; orientation of different substance-containing film; extraction of different substance from different substance-containing film; extraction of different substance-containing film, followed by orientating the so-treated film; laminatings of nonwoven fabrics; cross dispersing of bundle of fibers, followed by heat-pressing the resulting material; and irradiation of film with an electron beam. For example, suitable microporous films are commercially available, and are sold under the names of Celgard (Celanese Corp.), FP-2 (Asahi Chemical Industry), NOP (Nippon Oil Chemical Co., Ltd.), Nitto Flon (NTF) (Nitto Electric Industrial Co., Ltd.), Cellpore NW01 (Sekisui Chemical Co., Ltd.), Polyflon Paper (Daikin Industry Co.), NF sheet (Tokuyama Soda Chemical Co.) and so on.

In general the film has an air permeability of 0.01–10,000 sec/100 ml air, preferably 1–1,000 sec/100 ml air according to JIS P8117.

The nonwoven fabric sheets may be prepared by bonding fibers of plastics, such as polyethylene, polypropylene, polyfluoroethylene, polyester or polyamide by means of heat, pressure or adhesive. Nonwoven fabric sheets prepared by bonding long plastic fiber by means of heat or pressure. For example, suitable nonwoven fabric sheet is commercially available, and is sold under the name of TYVEK (E. I. Du Pont).

In general, the nonwoven fabric sheet has an air permeability of 0.01–10,000 sec/100 ml air, preferably 1–1,000 sec/100 ml air according to JIS P8117. The sheet is gas-permeable, but water-impermeable when there is no difference between pressure outside the bag and pressure in the bag.

The term "oxygen absorbent" in the specification and the claims means an agent for absorbing or removing oxygen present in the atmosphere of the container. Examples of the oxygen absorbents employed in the practice of this invention are disclosed in U.S. Pat. No. 4,113,652 by Yoshikawa et al patented on Sept. 12, 1978; U.S. Pat. No. 4,104,192 by Yoshikawa et al patented on Aug. 1, 1978; U.S. Ser. No. 816,135 by Ohtsuka et al filed on May 14, 1977; U.S. Pat. No. 4,127,503 patented on Nov. 28, 1978; U.S. Pat. No. 4,166,807 by Komatsu et al patented on Sept. 4, 1979, and U.S. Pat. No. 4,192,773 by Yoshikawa et al patented on Mar. 11, 1980 which are incorporated herein. Examples of the oxygen absorbents include reducing agent, such as iron powder, oxalates, sulfites, hydrogen sulfites, dithionites, pyrogallol, Rongalit, glucose, copper amine complex, zinc powder and the like, and any composition containing the reducing agent. A solid oxygen absorbent, a solid carrier impregnated with a liquid or semi-liquid oxygen absorbent, or a liquid or semi-liquid oxygen absorbent can be used as the oxygen absorbent of this invention. The solid oxygen absorbent and the solid carrier impregnated with the liquid or semi-liquid oxygen absorbent are preferred.

Films 3 having a lower softening point than film or sheet 1 include, for example, films made of polyethylene, polypropylene, ethylene-vinyl acetate copolymer and polyethylene ionomer and the like.

In general, the difference between a softening point of film or sheet 1 and that of film 3 may be above 5° C., preferably above 10° C. and most preferably above 20° C. So, materials constituting film 3 depends upon materials constituting film or sheet 1.

Similarly, the difference between a softening point of film 3 and that of film or sheet 4 may be above 5° C., preferably above 10° C. and most preferably above 20° C. Film or sheet 1 and film 4 may be made of the same or different material.

FIG. 1 shows an embodiment. The elements are: microporous film or nonwoven fabric sheet 1, film 3 having a lower softening point than 1, film 4 having a higher softening point than 3 and oxygen absorbent 5. Laminate sheet 2 may be prepared by extrusion-coating film 3 on film; adhering film 3 to film 4; pressing films 3 and 4; or forming film 3 on film 4 by coating a resin solution on film 4. Materials constituting film 4 are polyethylene terephthalate, polyamide, or polypropylene.

In general, thickness of film 1 may be in the range of 20–500μ, preferably 50–200μ, and thickness of laminate sheet 2 may be in the range of 20–200μ, and preferably 50–100μ.

The package of this embodiment may be prepared by putting an oxygen absorbent between film 1 and laminate sheet 2 with film 3 forming the inner layer followed by heat-sealing the three layers on the sides.

According to the present invention, more effective oxygen absorption can be achieved by embossing the outer surface of 1 since air can flow between adjacent ridges even when the outer surface of 1 is put into close contact with the product to be stored.

When printing is carried out on inner surface of film 4 or outer surface of film 3, the contents do not contact the printing ink.

The packages as explained above can be used for preserving foodstuffs. For example, when the package is packed with foodstuff in a package film so as to seal the package and the foodstuff, the oxygen absorbent contained in the package absorbs oxygen present in the package, whereby putrefaction or change in quality of the foodstuff can be prevented. The packages can be also used for preserving materials other than foodstuffs.

Since the film or sheet constituting outside material of the package is water impermeable, the bag can be packed with liquid or semi-liquid foodstuffs. In this case, the oxygen absorbent present in the package is completely prevented from contact with the liquid or semi-liquid foodstuffs of a container.

The packages of the present invention can be prepared at a high speed by using an ordinary heat seal machine.

This invention is now described in greater detail by reference to the following examples which are given here for illustrative purposes only and are by no means intended to limit the scope of the invention.

EXAMPLE 1

An ethylene-vinyl acetate copolymer film was extrusion-coated onto a polyethylene terephthalate film (15μ thick) to form a laminated film 50μ thick. The laminated film was heat-sealed to a polyethylene microporous film (Cellpore of Sekisui Chemical Co., Ltd.) on three sides in such a manner that the ethylene-vinyl acetate side faces inward, then 3 g of an oxygen absorbent composition was put in the individual envelopes at a rate of 80 shots/min, and thereafter, the remaining open side was heat-sealed, to thereby provide oxygen absorbent packages (50 mm×50 mm, seal width 5 mm). Each package was put in a laminated bag of oriented polypropylene film which is coated by polyvinylidenechloride and of polyethylene film together with cotton impregnated with 10 ml of water. The bag was filled with 500 ml of air and left at 25° C. Ten hours later, the oxygen concentration in the bag was reduced to 0.086%.

EXAMPLE 2

A polyamide film (15μ thick) was dry-laminated with a polyethylene film (20μ thick). The resulting laminated film and a polyethylene nonwoven sheet (TYVEK of Du Pont, U.S.A., 160μ thick) were loaded in a fast 4-side sealing/packing machine, in such a manner that the polyethylene film faced inward. As the laminated film and nonwoven sheet were heat-sealed with hot rolls, 3 g of an oxygen absorbent was supplied at a rate of 80 shots/min, to thereby provide oxygen absorbent packages (50 mm×50 mm, seal width: 5 mm). Each package was put in a laminated bag of oriented polypropylene film which is coated by polyvinylidenechloride and polyethylene film together with cotton impregnated with 10 ml of water. The bag was filled with 500 ml of air and left at 25° C. Ten hours later, the oxygen concentration in the bag was reduced to 0.063%.

What is claimed is:

1. An oxygen absorbent package comprising an outer layer of plastic film, a single intermediate layer of plastic film laminated to said outer layer, a porous plastic outer layer and an oxygen absorbent disposed between said intermediate layer and said porous outer layer, said intermediate layer having a lower softening point than said outer layers and being in contact with and heat sealed to said outer layers around their peripheral edges.

2. A package according to claim 1 wherein said plastic film outer layer and plastic film intermediate layer provide a gas impermeable laminate and said porous plastic outer layer consists of a microporous film or non-woven fabric sheet having a permeability between 0.01 and 10,000 sec. per 100 ml of air.

* * * * *